United States Patent [19]

McLaurin et al.

[11] Patent Number: 4,890,978

[45] Date of Patent: Jan. 2, 1990

[54] METHOD AND APPARATUS FOR VANE SEGMENT SUPPORT AND ALIGNMENT IN COMBUSTION TURBINES

[75] Inventors: Leroy D. McLaurin, Winter Springs; Roland E. Williams, Altamonte Springs; John P. Donlan, Oviedo, all of Fla.; Kent G. Hultgren, Swarthmore, Pa.

[73] Assignee: Westinghouse Electric Corp., Pittsburgh, Pa.

[21] Appl. No.: 259,811

[22] Filed: Oct. 19, 1988

[51] Int. Cl.[4] ..... F03B 3/18; F01D 25/00

[52] U.S. Cl. ..... 415/209.4; 415/138; 415/137; 415/189; 415/190

[58] Field of Search ..... 415/134, 136, 137, 138, 415/139, 160, 189, 190, 216, 217, 218

[56] References Cited

U.S. PATENT DOCUMENTS

| | | | |
|---|---|---|---|
| 2,738,949 | 3/1956 | Wilkinson | 415/217 |
| 2,819,871 | 1/1958 | McVeigh | 415/216 |
| 2,862,357 | 12/1958 | Haworth et al. | 415/160 |
| 3,824,034 | 7/1974 | Leicht | 415/218 X |
| 3,829,233 | 8/1974 | Scalzo et al. | 415/136 X |
| 3,843,279 | 10/1974 | Crossley et al. | 415/191 |
| 4,286,921 | 9/1981 | Donlan et al. | 415/190 X |

FOREIGN PATENT DOCUMENTS

| | | | |
|---|---|---|---|
| 52-68612 | 6/1977 | Japan | 415/137 |
| 2071776 | 9/1981 | United Kingdom | 415/189 |

*Primary Examiner*—Robert E. Garrett
*Assistant Examiner*—Hoang Minh Nguyen

[57] ABSTRACT

Methods and apparatus for vane segment alignment and support in a combustion turbine. The vane segment alignment device is comprised of a rotatable, eccentric bushing and pin which is inserted into a slot of the vane segment. The eccentric bushing is further comprised of a cover plate which is peened to a splined torque plate thus holding the eccentric bushing in place against the vane segment but allowing for fine adjustments of the alignment of the vane segments. The vane segment support and alignment device provides for efficient and economical adjustment of the vane segments especially in electric generating plants where combustion turbines undergo high peak load operation. Additionally, the vane segment support and alignment device transfers torques and moments generated by aerodynamic flow from the vane segments to an inner cylinder thereby reducing the amount of misalignment due to aerodynamic drag.

19 Claims, 3 Drawing Sheets

METHOD AND APPARATUS FOR VANE SEGMENT SUPPORT AND ALIGNMENT IN COMBUSTION TURBINES

BACKGROUND OF THE INVENTION

1. Field of the Invention

This invention relates generally to combustion or gas turbines, and more particularly to combustion turbines having vane segment support and alignment devices.

2. Description of the Prior Art

Over two thirds of large, industrial combustion turbines (which are also sometimes referred to "gas turbines") are in electric-generating use. Since they are well suited for automation and remote control, combustion turbines are primarily used by electric utility companies for peak-load duty. Where additional capacity is needed quickly, and where refined fuel is available at a low cost or where the turbine exhaust energy can be utilized, combustion turbines are also used for base-load electric generation.

In an electric generating environment, a typical combustion turbine is comprised of four basic portions: (1) an inlet portion; (2) a compressor portion; (3) a combustor portion; and (4) an exhaust portion. Air entering the combustion turbine at its inlet portion is compressed adiabatically in the compressor portion, and is mixed with a fuel and heated at a constant pressure in the combustor portion. Thereafter, the heated air is discharged through the exhaust portion with a resulting adiabatic expansion of the gases completing the basic combustion turbine cycle. This basic combustion turbine cycle is generally referred to as the Brayton or Joule cycle.

As is well known, the net output of a conventional combustion turbine is the difference between the power it produces and the power absorbed by the compressor portion. Typically, about two-thirds of combustion turbine power is used to drive its compressor portion. Thus, the overall performance of a combustion turbine is very sensitive to the efficiency of its compressor portion. In order to insure that a highly efficient high pressure ratio is maintained, most compressor portions are of an axial flow configuration having a rotor with a plurality of rotating blades axially disposed along a shaft and interspersed with a plurality of inner shrouded stationary vanes or vane segments which provide a diaphragm assembly having stepped labyrinth interstage seals.

A major factor in reducing compressor efficiency can be found in misalignment of the vane segments in a turbine with respect to a stationary cylinder assembly along the axis of the turbine. It is generally desirable to closely align the vane segments radially between the inner and outer cylinders of the turbine unit so that aerodynamic drag on the vane segments is minimized. These aerodynamic forces which act normally and tangentially upon the surfaces of the vane segments generate torques and moments that are desirably transferred to the casing of the combustion turbine rather than through the vane segments themselves. Otherwise, these torques and moments tend to knock the vane segments out of alignment. There has thus been a long-felt need in the art for apparatus and methods which transfer forces generated by aerodynamic air currents to a combustion turbine casing rather than through the vane segments of a combustion turbine.

Prior art approaches have utilized vane segments having inner and outer shrouds in a generally low-load environment. This approach utilized a cantilevered vane segment off the outer shroud while permanently fixing the vane segment and shroud to the inner and outer cylinders. However, the prior art approach fails with modern, high-load combustion turbines since the tolerances on the inner and outer cylinders of the turbine do not allow for precision alignment due to the sheer size of the vane segments themselves. Additionally, due to the large sizes of combustion turbines in use today it is impractical and uneconomical to physically remove the vane segments and shrouds from the cylinders in order to manually align the vane segments when aerodynamic forces reduce turbine efficiency. Furthermore, since misalignment of the vane segments in a turbine occurs relatively frequently especially in high-load environments, frequent fine-tuning alignment of the vane segments is impossible with the prior art cantilevered design.

Thus, there is a long-felt need in the art for a combustion turbine having adjustable vane segments between an inner and outer cylinder. Aerodynamic drag created by forces acting normally and tangentially upon the vane segments should be minimized by keeping the vane segments aligned radially between the inner and outer cylinders. Furthermore, the alignment of the vane segments in the combustion turbine should be achieved in an economic and efficient manner in the context of a high-load combustion turbine electric generating environment. It is also desirable to provide methods and apparatus for vane segment alignment which transfers torques and moments created by the aerodynamic flow of heated gases into the inner and outer cylinders and casing of the combustion turbine rather than through the vane segments.

SUMMARY OF THE INVENTION

Accordingly it is a general object of the present invention to provide an improved combustion turbine. More specifically, it is an object of the present invention to provide improved compressor vane segment alignment apparatuses for use in such combustion turbines and improved methods of aligning the vane segments between the inner and outer cylinders of the combustion turbine.

It is yet another object of the present invention to provide a vane segment alignment apparatus which transfers the loads generated by aerodynamic flow of heated gases from the vane segments to the inner and outer cylinders and the casing of the combustion turbine.

It is still another object of the present invention to provide a method of vane segment alignment in combustion turbines which substantially minimizes misalignment of the vane segments and transfers torques and moments generated by aerodynamic forces on the vane segments to the combustion turbine casing through the inner cylinder.

It is yet another object of the present invention to provide an apparatus which allows for efficient and economical alignment of large combustion turbine vane segments in a high-load electrical generation environment.

It is still another object of the present invention to provide a method of vane segment alignment in a combustion turbine generating system in an economical and efficient manner.

It is yet a further object of the present invention to provide methods and apparatus for aligning the vane segments between the inner and outer cylinder of a combustion turbine thereby increasing turbine efficiency and electrical generation efficiency.

It is still another object of the present invention to provide a vane segment support and alignment device for use in combustion turbines that is readily and inexpensively manufactured by existing technology and is easily installed or replaced with a known combustion turbine.

Briefly these and other objects, advantages and novel features according to the present invention are provided in a combustion turbine having an inlet portion, a compressor portion, a combustor portion, an exhaust portion, a plurality of vane segments in the combustor portion, and an outer cylinder for circumferentially and radially fixing one end of the vane segments to the outer cylinder. An inner cylinder is provided for adjustably securing the other end of the vane segments, each vane segment having a slot located on the end of the vane segment adjustably secured to the inner cylinder. Means for aligning the vane segments between the inner and outer cylinders is provided and mounted to the inner cylinder.

In accordance with one important aspect of the present invention, misalignment relative to the inner and outer cylinders caused by aerodynamic forces upon the vane segments is substantially eliminated since the vane segment aligning device can be manually activated to position the plurality of vane segment radially between the inner and outer cylinders. Furthermore, in a preferred embodiment of the invention aerodynamically induced torques and moments are transferred through torque plates mounted on the inner cylinder rather than through the vane segments thereby reducing dynamic misalignment of the vane segments during turbine operation. Aerodynamically induced torques and moments are ultimately transferred to the turbine casing where they are harmlessly dissipated. Improved alignment of the vane segments in the combustion turbine dramatically improves turbine efficiency, thus reducing costs of electricity production. Additionally, the apparatus for vane segment alignment described in accordance with this invention allows for the efficient and easy adjustment of the vane segments in a minimal amount of time thereby reducing maintenance costs and down time for the combustion turbine.

The above and other objects, advantages and novel features according to the present invention will become more apparent from the following detailed description of preferred embodiments thereof considered in conjunction with the accompanying drawings.

DETAILED DESCRIPTION OF PREFERRED EMBODIMENTS

Figure 1:
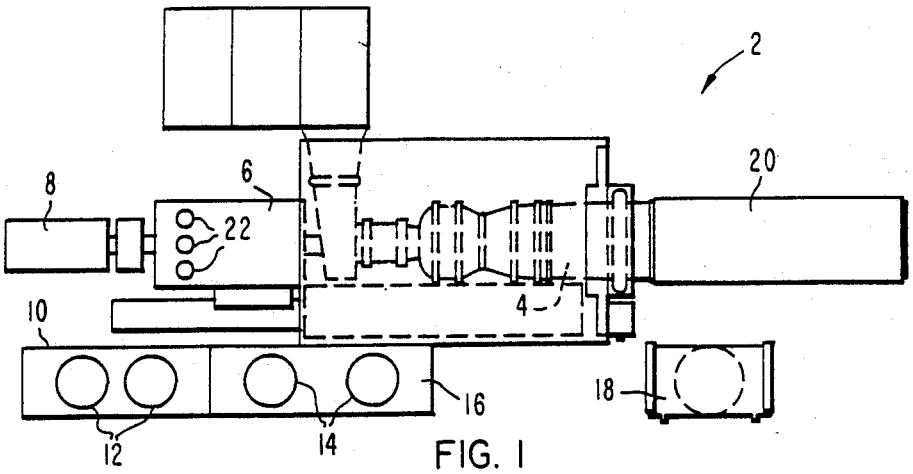
FIG. 1 is a layout of a typical electric generating plant which utilizes a combustion turbine.

Combustion turbines are generally comprised of an inlet portion, a compressor portion, a combustor portion, an exhaust portion, and a plurality of vane segments in said combustor portion which are radially and circumferentially fixed on an outer cylinder. In a preferred embodiment of the present invention, an inner cylinder is supplied wherein the other end of the vane segments are adjustably secured. In further preferred embodiments of the invention each vane segment is slotted on the end which is attached to the inner cylinder. According to the present invention, means for aligning each vane segment between both the inner and outer cylinders is supplied and is mounted to the inner cylinder.

Preferably the means for aligning the vane segments is comprised of a means for securing the alignment means to the inner cylinder by, for example, a torque plate. A "torque plate" is herein defined to be a plate which transfers aerodynamic forces and moments to the inner cylinder. In further preferred embodiments the torque plate has a splined center hole. It is also generally desired to provide a rotatable, eccentric bushing which is disposed through said splined center hole such that the rotatable, eccentric bushing will engage the splined center hole when the vane segments are aligned. The rotatable bushing is "eccentric" in that it has at least two distinct diameters rather than being strictly cylindrical.

In preferred embodiments according to this invention a threaded cover plate is provided in cooperative relation to the eccentric bushing. The cover plate is mounted to the torque plate such that the one diameter of the eccentric bushing is engageable with the threads of the cover plate while another diameter of the eccentric bushing is engageable with the splines of the torque plate. Thus in preferred embodiments, the eccentric bushing is fixedly and securedly contained against the vane segments thereby holding the vane segments in alignment between the inner and outer cylinders.

In still further preferred embodiments of the present invention, a pin is mounted to the one diameter of the eccentric bushing and cooperates with the slot located on the vane segment end adjustably attached to the inner cylinder. The pin acts to provide alignment of the vane segments between the inner and outer cylinders according to the rotation of the eccentric bushing during the alignment process. Furthermore, the bushing, torque plate and cover plate assembly serves to transfer aerodynamically induced torques and forces which tend to put the vane segments out of alignment through the inner cylinder and eventually to the casing of the combustion turbine rather than the vane segments. Thus, the apparatus in accordance with this invention for vane segment alignment in combustion turbines fulfills the long-felt needs in the art for a device which economically and efficiently allows for alignment of the vane segments and for a device which transfers aerodynamically-induced torques and moments to the turbine casing rather than the vane segments.

Figure 2:
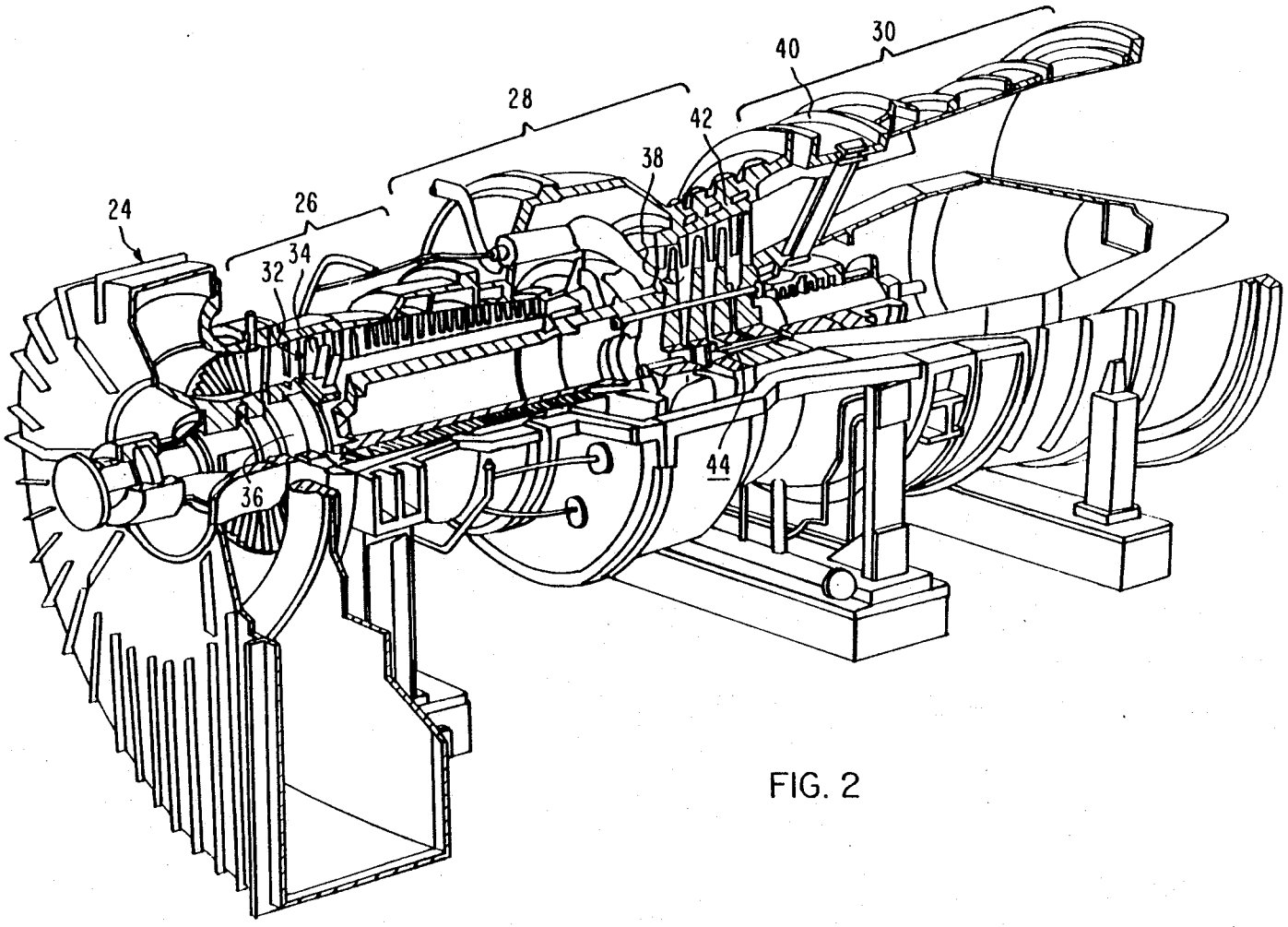
FIG. 2 is an isometric view partially cut away of the combustion turbine shown in FIG. 1.

Referring now to the drawings wherein like characters designate like or corresponding parts throughout each of the several views, there is shown in FIG. 1 the layout of a typical electric generating plant 2 utilizing a well-known combustion turbine 4 (such as the model W-501D single shaft, heavy duty combustion turbine that is manufactured by the Combustion Turbine Systems Division of Westinghouse Electric Corporation). As is conventional, the plant 2 includes a generator 6 driven by the turbine 4, a starter package 8, an electrical package 10 having glycol cooler 12, a mechanical package 14 having an oil cooler 16, and an air cooler 18, each of which support the operating turbine 4. Conventional means 20 for silencing flow noise associated with the operating turbine 4 are provided for at the inlet duct and at the exhaust stack of the plant 2, while conventional terminal means 22 are provided at the generator 6 for conducting the generated electricity therefrom. FIG. 2 is an isometric view of the turbine 4 in greater detail. The turbine 4 is comprised generally of an inlet portion 24, a compressor portion 26, a combustor portion 28, and an exhaust portion 30. Air entering the turbine 4 at its inlet portion 24 is compressed adiabatically in a compressor portion 26, and is mixed with a fuel and heated at a constant pressure in the combustor portion 28. The heated fuel/air gases are thereafter discharged from the combustor portion 28 through the exhaust portion 30 with a resulting adiabatic expansion of the gases completing the base combustion turbine cycle. Such a thermodynamic cycle is alternatively referred to as the Brayton or Joule cycle.

In order to insure that a desirable, highly efficient and high-pressure ratio is maintained in the turbine 4, the compressor portion 26, like most compressor portions of conventional combustion turbines, is of an axial flow configuration having a rotor 32. The rotor 32 is generally comprised of a plurality of rotating blades 34 which are axially disposed along a shaft 36. The casing 40 generally encloses the entire turbine.

Figure 3:
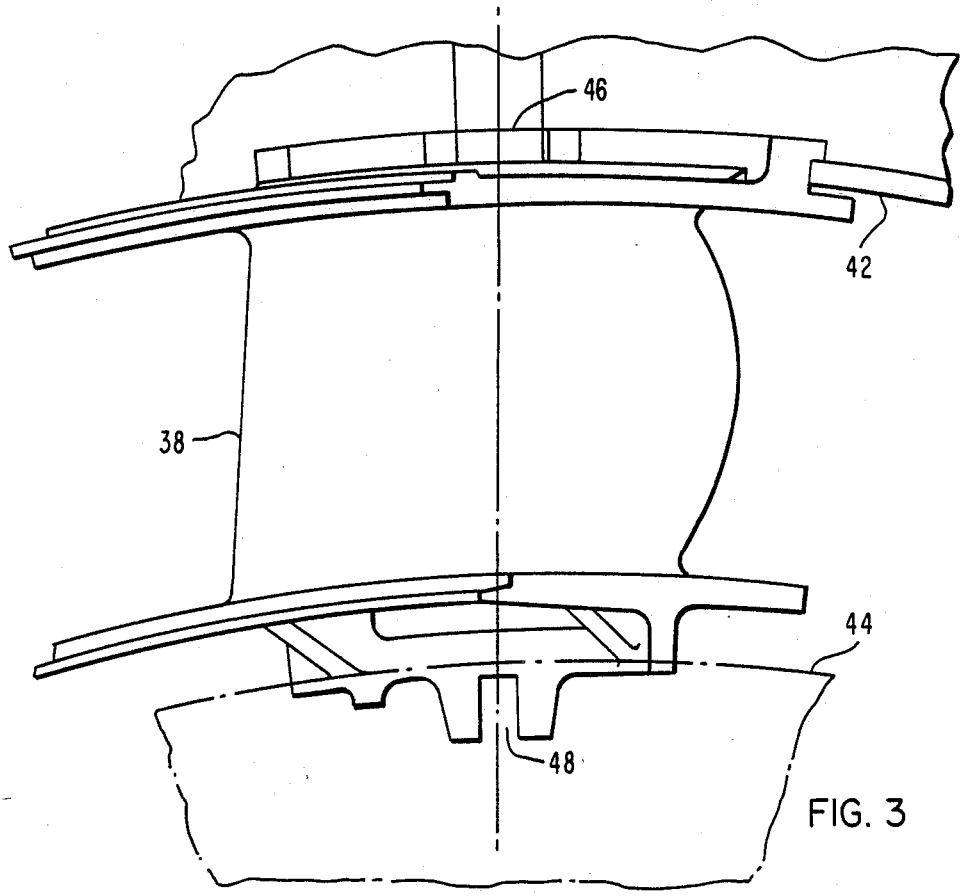
FIG. 3 shows one of a plurality of vane segments on a combustion turbine mounted to an inner and outer cylinder.

In high-load situations, the electric generating plant 2 is required to produce a large amount of electricity. In the high-load situation turbine 4 is operating at peak or near-peak capacity such that aerodynamic flow produced by the hot air and fuel mixture moving from the inlet section 24 on through to the exhaust portion 30 impinges.-on the vane segments 38 in FIG. 3. This flow in turn produces aerodynamically-induced stresses, torques and moments on the vane segments tending to throw them out of alignment. FIG. 3 shows a basic vane segment design wherein the design is comprised of vane segment 38, an outer cylinder 42, and an inner cylinder 44. Vane segment 38 is generally fixedly mounted to outer cylinder 42 at 46.

In accordance with this invention, vane segment 38 is provided with a slot 48 whereby vane segment 38 can be aligned between outer cylinder 42 and inner cylinder 44. Alignment of the vane segments is accomplished with the devices and apparatus described in accordance with this invention. Vane segment 38 is held circumferentially and radially with respect to inner cylinder 44 and outer cylinder 42 by the axial positioning of the vane segment relative to the inner and outer cylinder.

Figure 4:
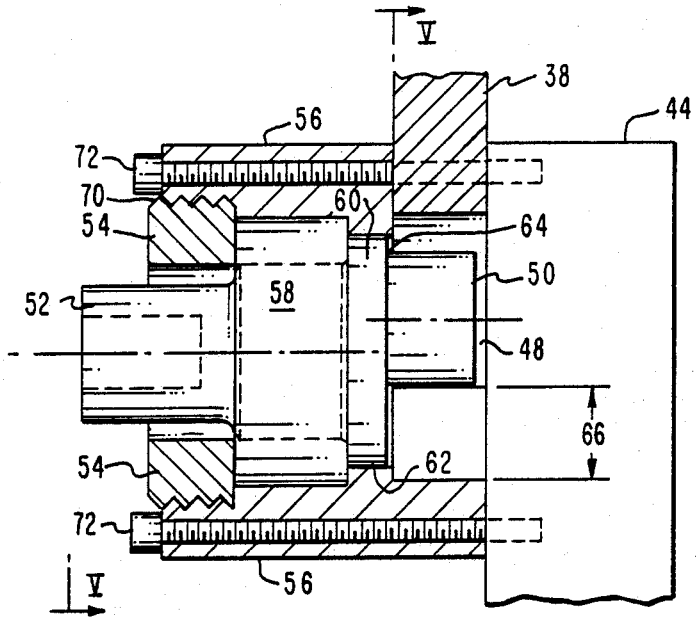
FIG. 4 depicts a preferred embodiment of the vane segment support and alignment device as it engages a vane segment.

Referring now to FIG. 4, the vane segment support and alignment device is shown. Vane segment,, 38 is adjustably attached to inner cylinder 44. Slot 48 in vane segment 38 is adapted to receive pin 50 such that pin 50 is frictionally held in slot 48. Eccentric bushing 52 mounted to pin 50 is provided thereby allowing pin 50 to adjust vane segment 38 as eccentric bushing 52 is rotated. A threaded cover plate 54 is provided and mounted to eccentric bushing 52 so that eccentric bushing 52 can be rotated to force pin 50 to align vane segment 38. Additionally, a threaded torque plate 56 is mounted to the inner cylinder 44 through vane segment 38 such that the eccentric bushing 52 is secured to the torque plate 56 by the preening of the threads on the torque plate 56 and cover plate 54.

The torque plate 56 is provided with a center hole 58 to receive the large diameter end of eccentric bushing 52. Center hole 58 is splined at 60. Pin 50 is also splined at 62 such that, after the vane segment alignment is made, the eccentric bushing 52 is engaged into the spline of the torque plate 60 so that the pin end 50 of bushing 52 is locked into slot 48 of vane segment 38. The splines 60 and 62 are then engaged allowing for fine adjustment of pin 50 relative to the vane segment 38 and slot 48 by minor adjustments and rotations of bushing 52. The bushing and pin assembly limits the axial travel of the vane segment during turbine operation by providing a small axial clearance 64 between torque plate 56 and vane segment 38. Axial clearance 64 is kept to a minimum by the eccentric bushing and pin assembly thereby producing highly accurate alignment of vane segment 38 between inner cylinder 44 and outer cylinder 42. Furthermore, the eccentric bushing and pin assembly maintains the circumferential and radial alignment of vane segment 38 to a high degree of accuracy when thermal growth area 66 between torque plate 56 and vane segment 38 undergoes large fluctuations. In a preferred embodiment, torque plate 56 is secured to inner cylinder 44 with bolts 72.

Figure 5:
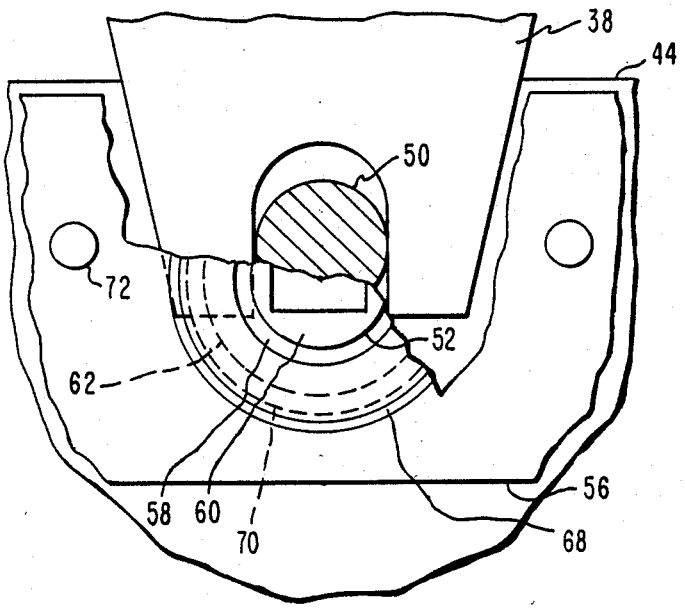
FIG. 5 is the vane segment support and align device cut along the 5—5 line on FIG. 4.

FIG. 5 is a view of the vane segment alignment device viewed along the 5—5 line of FIG. 4. FIG. 5 illustrates the peening and splining arrangement of the eccentric bushing 52 with the torque plate 56 and cover plate 54. The peening area of the torque plate and cover plate is shown at 68. Engagement of the threads 70 of the torque plate 56 and the cover plate 54 is illustrated. Rotation of the eccentric bushing along the threads 70 allows for adjustment of the pin 50 in the slot 48 of vane segment 38.

Center hole 58 of torque plate 56 is splined at 60. Pin 50 is splined at 62 in such a manner that pin 50 engages torque plate 56 and locks to eccentric bushing 52 securedly in place after the alignment is made. The splining arrangement allows for the fine adjustment of vane segment 38 relative to the inner and outer cylinders. The vane segment alignment and support device thus satisfies a long-felt need in the art for a device which maintains accurate alignment of vane segments both circumferentially and radially between an inner and outer cylinder of a combustion turbine.

In preferred embodiments, a method of manufacturing a gas turbine having a plurality of slotted vane segments with two ends is provided in accordance with this invention. It is generally desired to provide an outer cylinder of a combustion turbine such that one end of the vane segments are radially and circumferentially fixedly mounted to the outer cylinder. It is then generally desired to provide an inner cylinder such that the other end of the vane segments are adjustably mounted to the inner cylinder. In preferred embodiments a plurality of eccentric bushing devices in corresponding cooperative relation with each of the slotted vane segments are provided which can align the vane segments. Using the eccentric bushings, the vane segments are then aligned.

There has thus been described apparatus and methods for aligning vane segments in combustion turbines. Many modifications and variations are possible in light of the foregoing detailed description of preferred embodiments. Therefore, it will be understood by those with skill in the art that modifications and variations of the described preferred embodiments are within the spirit and scope of the appended claims and that the invention described by the appended claims may be practiced otherwise than as specifically contained herein.

What is claimed is:

1. A gas turbine having an apparatus for supporting and aligning a vane segment comprising:
   a torque plate having a center hole;
   a rotatable, eccentric bushing disposed within said center hole of said torque plate; and
   a pin in cooperative relation to said rotatable bushing such that when said rotatable bushing is rotated said pin engages said vane segment thereby aligning said vane segment.

2. The gas turbine of claim 1 wherein said center hole is splined.

3. The gas turbine of claim 2 wherein said pin engages said splines in said center hole such that said pin is secured to said vane segment.

4. The gas turbine of claim 1 further comprising a cover plate mounted to said rotatable, eccentric bushing to secure said bushing to said torque plate.

5. The gas turbine of claim 4 wherein said cover plate is threaded.

6. The gas turbine of claim 5 wherein said torque plate is threaded to engage the threads on said cover plate such that said cover plate is locked to said torque plate by a peening of the threads on said cover plate and the threads on said torque plate.

7. In a combustion turbine having an inlet portion, a compressor portion, a combustor portion, an exhaust portion, a plurality of vane segments in said combustor portion and an outer cylinder for fixing one end of said vane segments, an improved vane segment support and alignment apparatus comprising in combination therewith:
   an inner cylinder for adjustably securing the vane segments; and
   a plurality of means mounted to said inner cylinder for supporting and aligning said vane segments circumferentially and radially between said inner cylinder and said outer cylinder, said means for supporting and aligning further comprising means for securing said means for aligning to said inner cylinder, said means for securing having a center hole, and a rotatable eccentric bushing having a pin end disposed through said center hole.

8. The combustion turbine of claim 7 wherein the means for securing is a torque plate.

9. The combustion turbine of claim 8 wherein the center hole is splined.

10. The combustion turbine of claim 9 wherein said pin end is splined such that said bushing engages said splined center hole when said vane segments are aligned.

11. The combustion turbine of claim 7 further comprising a cover plate mounted to said means for securing said means for supporting and aligning to said inner cylinder, said cover plate in cooperative relation with said rotatable, eccentric bushing such that said cover plate secures said rotatable, eccentric bushing to said means for securing said means for aligning to said inner cylinder.

12. The combustion turbine of claim 11 wherein said cover plate secures said bushing to said means for securing by peening of threads located on said cover plate and said means for securing.

13. The combustion turbine of claim 12 wherein said pin finely adjusts the alignment of said vane segment with small rotations of said bushing.

14. The combustion turbine of claim 13 wherein said means for securing transfers aerodynamically induced torques and moments to said inner cylinder.

15. A method of manufacturing a gas turbine having a plurality of slotted vane segments with two ends in said turbine the step of the method comprising:
   providing an outer cylinder;
   mounting one end of said vane segments fixedly to said outer cylinder;
   providing an inner cylinder;
   mounting the other end of said vane segments adjustably to said inner cylinder; and
   providing a plurality of rotatable, eccentric bushings in corresponding cooperative relation with each of said slotted vane segments for aligning said vane segments.

16. The method of claim 15 further comprising the steps of:
   engaging said rotatable eccentric bushings in a splined torque plate that is mounted to said inner cylinder such that a pin mounted to each of said rotatable, eccentric bushings fits into the slots of said vane segments; and
   causing said rotatable eccentric bushings and said pins to make fine adjustments of the alignment of said vane segments individually.

17. The method of claim 16 comprising the further step of:
   providing a threaded cover plate mounted to each of said rotatable, eccentric bushings such that said rotatable, eccentric bushings are peened to said torque plate through each of said cover plates.

18. The method of claim 17 wherein the alignment of said slotted vane segments is maintained independent of thermal growth fluctuations of said vane segments.

19. The method of claim 17 further comprising the step of:
   providing clearance between said vane segments and said torque plate thereby limiting axial travel of said vane segment.

* * * * *